United States Patent [19]

Porter

[11] 4,166,422

[45] Sep. 4, 1979

[54] TOP FEED FOR SEWING MACHINE

[76] Inventor: Robert E. Porter, 5 Oak St., Hamilton, Mass. 01982

[21] Appl. No.: 939,967

[22] Filed: Sep. 6, 1978

[51] Int. Cl.[2] ..... D05B 27/06

[52] U.S. Cl. ..... 112/311

[58] Field of Search ..... 112/207, 212, 215, 203

[56] References Cited

U.S. PATENT DOCUMENTS

| | | | |
|---|---|---|---|
| 3,530,809 | 9/1970 | Porter | 112/207 |
| 3,636,899 | 1/1972 | Crisler | 112/207 |
| 3,995,571 | 12/1976 | Porter | 112/207 |

FOREIGN PATENT DOCUMENTS

| | | | |
|---|---|---|---|
| 445275 | 2/1968 | Switzerland | 112/207 |

*Primary Examiner*—Werner H. Schroeder
*Assistant Examiner*—Andrew M. Falik
*Attorney, Agent, or Firm*—Kenway & Jenney

[57] ABSTRACT

A top feeding device for advancing the upper layer of material in synchronism with the lower layer of material being sewn. The top feeding device includes an upper feed dog moving periodically in conjunction with a lower feed dog to grip and advance the materials being sewn along a path related to the stroke of the stitching needle or needles of the sewing machine. Drive for the top feeder is derived from an eccentric cam mounted on the sewing machine main drive shaft, motion being positively transferred to a pivotal upper feed dog arm by means of a lever arm depending from that arm and being a cam-following surface held under adjustable pressure in contact with the eccentric cam. The pivot for the upper feed dog arm is disposed upon an extension of the main lower feed bar which thereby provides horizontal motion to both the upper and lower feed dog arms.

5 Claims, 1 Drawing Figure

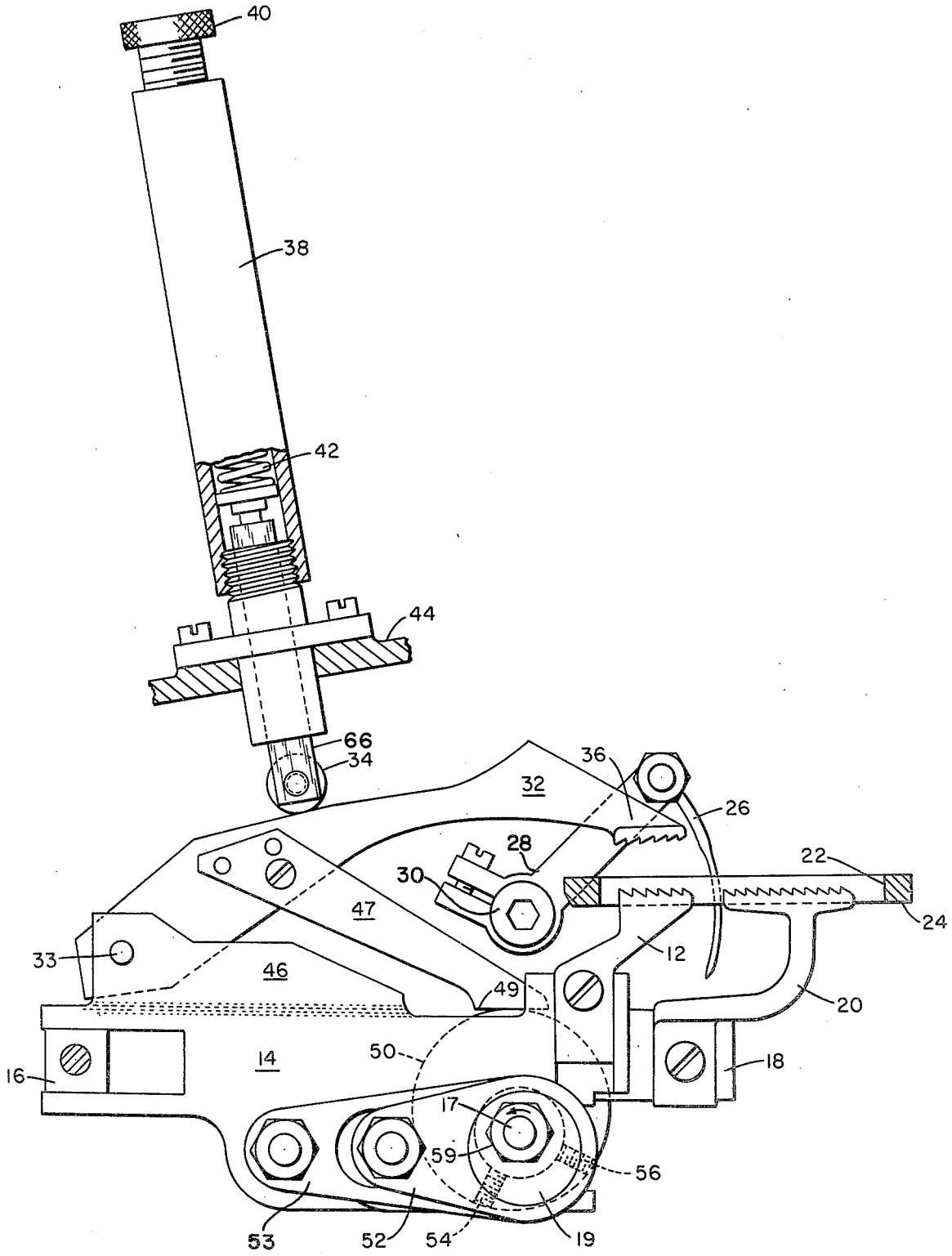
40
38
42
44
66
34
36
32
26
28
22
30
24
47
12
33
46
49
20
50
14
18
16
17
59
56
53
52
54
19

TOP FEED FOR SEWING MACHINE

BACKGROUND OF THE INVENTION

This invention relates in general to work feeders for sewing machines and in particular to an improved and simplified top work feeder.

From the early days of their development, sewing machines have been provided with a lower feed mechanism which is usually located in an opening in the work surface of the machine adjacent the stroke of the sewing machine needle or needles. Generally, these feeders have upwardly-facing serrated surfaces which cyclically engage and advance the lowermost surface of the layers of material being sewn in synchronism with the stitching stroke of the needle.

In those early days it was left to the skill of the operator to advance or retard the movement of the upper layers of the material being sewn and to smooth wrinkles in order that they would be sewn in proper unison with the lower layer or layers. Several attempts have been made to simplify the operator's task and to provide a more uniform output by automating the feed of the upper layers of material being sewn and to coordinate that feed with the lower feed. One of the earliest attempts involved a flexible cable drive for the top feeder, the flexible cable being synchronized as well as possible with the drive of the bottom feeder. The results obtained were not always uniformly good and the complexity and interference with sewing operations caused by the flexible cable apparatus precluded its widespread adoption.

More recently, U.S. Pat. Nos. 3,530,809 and 3,995,571 issued to the present inventor and the arrangements described and claimed in those patents have enjoyed substantial success. The disclosures of those two patents are incorporated herein by reference to serve as background. However, several years' experience with the devices which constitute the subject matter of those two patents has indicated that a further simplification and improvement of top feeding is feasible. Accordingly, the primary object of the present invention is the reduction of noise and wear in top feeding devices. A further object is more uniform and consistent positive feeding of materials. Another object is the reduction of complexity and the further clearing of work space in and about top feeding apparatus in sewing machines.

SUMMARY OF THE INVENTION

As in the case of the inventions of the two patents of the present inventor mentioned above, conventional lower feed arrangements for periodically engaging and disengaging the lowermost surface of material or materials being sewn are employed. The lower feed, which may include a main feed dog and a differential feed dog, operates in the same manner as that of the earlier patented devices to engage the under surface of the material being sewn and move the material along a predetermined path relative to and in synchronism with the stroke of the stitching needle. Again, an upper feed dog is also utilized and it is caused to move in synchronism with the lower feed dogs. Thus, the uppermost surface and lowermost surface of the materials being sewn are engaged simultaneously for movement into the path of the needle stroke following which the needle retracts and the feed dogs disengage from the materials and return to their original location to grip the materials again. The apparatus of the present invention differs from that of the previous two patents principally in the improvements which have been made in the drive mechanism for the top or upper feed and in the adjustable mechanism for biasing the upper feed toward the lower feed mechanism.

More specifically, drive for the top feeder is now derived from precisely the same source as the drive for the bottom or lower feed mechanism. Also, rather than intermittent contact between elements of the drive train, a continuous positive connection is employed which avoids vibration, noise and lack of uniform action. Additionally, biasing of the top feeder toward the bottom feeder is made smooth and easily adjustable through the agency of a spring-loaded roller-cam bearing upon a contoured surface of the top feeder arm.

BRIEF DESCRIPTION OF DRAWING

For a better understanding of the present invention, together with other and further objects, features and advantages reference should be made to the accompanying drawing, the single FIGURE of which is an end elevation of the feeding mechanism for a sewing machine illustrating fragmentarily portions of the machine and the feeding arrangement.

DETAILED DESCRIPTION OF A PREFERRED EMBODIMENT

In the drawing, there is shown in outline the feeding mechanism of the present invention as well as fragmentary portions of the sewing machine to which the feeding mechanism is applied. The actual machine may be of the type disclosed in catalogue No. 103S, Second Edition, of the Union Special Machine Company, entitled "Streamlined High-Speed Overseamers", published by Union Special Machine Company of Chicago, Illinois in March of 1966. Reference is made to that catalogue only for purposes of setting one background in which the present invention is operative. Of course, the invention may be applied to any one of a variety of sewing machines where feed for an upper layer of an assembly to be sewn is needed. Among the other machines to which the present invention is applicable with minor modifications are those illustrated in a catalogue entitled "Parts Book", Revision No. 3 (Models Mo-804, Mo814, Mo816) published by Tokyo Juki Industrial Company, Ltd. of Tokyo, Japan.

Most details of conventional apparatus have been eliminated from the drawing in order not to obscure the structural modifications and to aid in understanding of the novel sequence of operations involved in the practice of the present invention. Certain other conventional sewing machine elements are illustrated, however, to facilitate understanding and appreciation of the present invention. Among those elements is a main lower feed dog 12 having a serrated upper surface adjustably mounted by means of a screw in a vertical slot formed at one end of a main feed bar 14. The main feed bar 14 extends rearwardly and terminates in a horizontal slot which receives a conventional feed bar slide block 16. A differential feed bar 18 generally aligned with the main feed bar 14 supports a differential feed dog 20 in substantially the same manner as the main feed dog 12 is supported by the main feed bar 14. Each of the feed dogs 12 and 20 has the serrated upper surface and is operative within an opening 22 in a throat plate 24, the top of which is a level surface generally continuous with the working surface of the sewing machine over which materials to be sewn pass. Details of the drive for the lower feed dogs are omitted because they are well known to those skilled in the art and are illustrated in one or more of the catalogues and patents cited above. By way of explanation, however, it should be noted that the vertical motions of the lower feed dogs 12 and 20 are the same but that their horizontal motions differ slightly in order that the material being sewn is smoothly advanced in such a fashion that wrinkling is avoided.

The illustrated sewing machine is provided with a curved needle 26 which is conventionally driven reciprocally to pass through the material being sewn into the opening 22 in the throat plate and then to retract from that opening. The needle need not be curved and, in some cases, is preferably a straight needle operating in substantially the same manner to pass reciprocally through the material being sewn into and out of the opening 22. The reciprocal motion is achieved by the connection of the needle through its arm 28 to a shaft 30 which is cam-driven or otherwise connected back to a main drive shaft 17 to rotate first in one direction and then in the other. Also, as is well-known in sewing machine design, the feed dogs 12 and 20 have their horizontal and vertical motions precisely timed relative to the reciprocal motion of the needle 26. However, as noted in the above-mentioned U.S. Pat. No. 3,530,809, with only the lower layer of material being positively advanced by the feed dogs 12 and 20, relative slippage (between that layer and other layers of materials being sewn) can occur and frequently does.

To avoid such slippage between layers of material being sewn, an upper feed arm 32 is provided. The upper feed arm 32 is pivotally attached to an extension 46 of the main feed arm 14 and is thus driven horizontally in synchronism with the main feed arm 14. The pivotal attachment of the upper feed arm 32 to the extension 46 is made by means of a pin 33 passing through the arm 32 and the extension 46 adjacent their ends. The other end of the arm 32 extends forwardly to terminate in an upper feed dog 36, the serrated lower surface of which is aligned with the serrated upper surface of the lower main feed dog 12. The pinned end of the arm 32 has a flat under surface which limits its clockwise movement and has an upper surface shaped to accommodate a cam roller 34 rotatably mounted upon a shaft 66 which is spring-loaded into a cylinder 38. An adjusting knob 40 is threaded into the cylinder 38 to bear upon a spring 42 which bears in turn upon the shaft 66. The entire spring-loaded assembly is mounted by means of a suitable sleeve and threaded connector upon a bracket 44 supported from the frame (not shown) of the sewing machine. As has previously been noted, the top feed arm 32 is pivoted about the pin 33 which passes through the main feed bar extension 46. The extension 46 may be made integral with the main feed bar 14 or may be a separate element welded to the main feed bar 14. The latter alternative is, of course, preferred when an existing machine is to be modified as, for example, when additional parts needed for the top feeder are supplied in kit form.

Attached to the upper feed arm 32 is an actuating lever arm 47 which extends forwardly and at an angle depending from the lever arm 32. At the end of the lever arm 47 a cam following surface 49 is formed and it bears upon a large eccentric cam 50. The large eccentric cam 50 is held in place upon the main shaft 17 by means of set screws 54 and 56. Also mounted upon the main drive shaft 17 is a smaller eccentric cam 19 with linkages 52 and 53 conventionally used in sewing machines for lower feed bar drives. A lock nut 59 is then threaded upon the end of the shaft 17.

As is explained in the above-cited U.S. Pat. No. 3,530,809, the lower feed dogs drop to the position in which they are shown at the end of a stitching stroke of the needle 26. Then, the lower feed dogs are carried to the right by the action of the eccentric coupling and the links between those feed bars and the main drive shaft. As the shaft 17 continues its rotation, the lower feed dogs rise through the opening 22 as the needle 26 retracts. At this point, the serrated upper surfaces of the lower feed dogs engage the under surface of the material being sewn and the linkage causes them to move to the left. The operation of the lower feed dogs as described above is conventional and is not a part of the present invention.

It is necessary that the movement of the upper feed dog 36 be synchronized with the action of the lower feed dogs and, as noted in U.S. Pat. No. 3,530,809, the action of the upper feed dog is essentially a mirror image of the action of the lower main feed dog 12. In the present case, however, the vertical action is derived from the rotation of the large eccentric cam 50 against the surface of which the cam follower 49 of the lever arm 47 is held by the action of the pressure applicator 38. The large eccentric cam 50 is so disposed angularly upon the main drive shaft 17 relative to the eccentric 19 that the upper feed dog 36 and the lower feed dog 12 move in unison in the feeding motion.

Horizontal motion, of course, is essentially identical for both the upper and lower feed dogs because the upper feed arm 32 is pivoted upon the extension 46 on the main lower feed bar 14.

The feeding motion is accompanied by rotational movement of the roller 34 over the upper cam following surface of the upper feed arm 32. It will be seen that the various cams and cam followers are in continuous contact with each other. For example, the roller 34 is at all times in contact with the upper surface of the upper feed arm 32 and the cam following surface 49 is at all times in contact with the large eccentric cam 50. As a result, quiet operation and minimum wear are encountered as contrasted to prior art mechanisms in which contact is made and broken. Because the sewing machines run at relatively high speeds, the making and breaking of contact is the principal cause of noise and wear and such operation is not employed in the present invention.

It has been suggested above that the top feeder of the present invention may be supplied in kit form. To avoid the only modification which would involve serious structural change, a new main feed bar 14 with an integrated or welded extension 46 is supplied as a part of the kit to be substituted for the existing conventional main feed bar. Mounting of the eccentric cam 50 in proper orientation on the shaft 17 is simplified by suitably flattening or marking the shaft 17 to indicate the points of contact of one or both of the set screws 54 and 56. Other simple indicators may be used to facilitate the employment of a modification kit.

The simplified, positive power take-off for driving the upper feed apparatus leaves a clear working area as well as clearance for multi-needle operation. Continuous rather than intermittent power transfer eliminates noise and reduces wear.

What is claimed is:

1. In a sewing machine having at least one reciprocating stitching needle and at least one lower feed dog for engaging and disengaging the lower surface of material to be sewn to move said material along a predetermined path relative to the stroke of said needle, drive means for actuating said lower feed dog including a rotating shaft, the combination of an upper feed dog arm pivotally linked to said drive means to cause said upper feed dog to move substantially in synchronism with said lower feed dog, an actuating lever arm having an end thereof fixedly connected to said upper feed dog arm and extending toward said rotating shaft, an eccentric cam mounted upon said rotating shaft, said actuating lever arm having a cam-following surface formed thereon and in contact with said eccentric cam and means resiliently maintaining said cam-following surface in contact with said cam, the contour of said cam being such that with rotation of said rotating shaft said upper feed dog and said lower feed dog periodically engage and disengage the upper and lower surfaces of said material respectively in synchronism with reciprocating movement of said stitching needle to feed said material along said predetermined path relative to the stroke of said stitching needle.

2. In a sewing machine as defined in claim 1, the combination wherein said rotating shaft is the main drive shaft of said sewing machine, said drive means for actuating said lower feed dog includes a main lower feed bar having an extension formed thereon and said upper feed dog arm is pivotally attached to said extension.

3. In a sewing machine as defined in claim 2, the combination wherein said lever arm is fixed to said upper feed dog arm at a point between said pivotal link and said cam-following surface formed thereon.

4. In a sewing machine as defined in claim 1, the combination wherein said means resiliently maintaining said cam-following surface in contact with said eccentric cam comprises an adjustable spring-loaded assembly having a cam-roller urged into contact with a contoured surface of said upper feed dog arm.

5. In a sewing machine as defined in claim 4, the combination wherein said cam-following surface is in continuous contact with said eccentric cam and said cam-roller is in continuous contact with said contoured surface of said upper feed dog arm.

* * * * *